US005334018A

United States Patent [19]

Young

[11] Patent Number: 5,334,018

[45] Date of Patent: Aug. 2, 1994

[54] DENTAL CONTROL UNIT WITH REMOVABLE COVER

[75] Inventor: Barry S. Young, Tualatin, Oreg.

[73] Assignee: MDT Corporation, Torrance, Calif.

[21] Appl. No.: 998,245

[22] Filed: Dec. 8, 1992

[51] Int. Cl.[5] ..... A61G 15/00

[52] U.S. Cl. ..... 433/77; 433/78

[58] Field of Search ..... 433/77, 78, 79, 28, 433/98; 312/209

[56] References Cited

U.S. PATENT DOCUMENTS

| | | | |
|---|---|---|---|
| 3,702,940 | 11/1972 | Stewart | 433/28 |
| 3,972,120 | 8/1976 | Cope | 433/78 |
| 4,386,910 | 6/1983 | Cattani | 433/79 |
| 4,571,182 | 2/1986 | Beier et al. | 433/79 |
| 5,029,576 | 7/1991 | Evans, Sr. | 433/80 |

FOREIGN PATENT DOCUMENTS

| | | | |
|---|---|---|---|
| 0094470 | 11/1983 | European Pat. Off. | 433/77 |
| 2552957 | 6/1977 | Fed. Rep. of Germany | 433/78 |
| 3514831 | 11/1986 | Fed. Rep. of Germany | 433/77 |

*Primary Examiner*—Gene Mancene
*Assistant Examiner*—Nicholas D. Lucchesi
*Attorney, Agent, or Firm*—Trask, Britt & Rossa

[57] ABSTRACT

A dental control unit for use by dentists and having a base, a housing on the base to enclose control structure for dental handpieces and connections for conduits interconnecting the control structure and the handpieces and a removable top cover that is fitted over the housing to prevent spattering of contaminating fluids onto the housing and that further includes parallel, spaced apart elongate cavities that are shaped to receive, position and maintain separated the conduits and attached handpieces placed on the top cover.

10 Claims, 4 Drawing Sheets

DENTAL CONTROL UNIT WITH REMOVABLE COVER

BACKGROUND OF THE INVENTION

1. Field:

This invention relates to dental control units. It is particularly directed to such units in which a support base carries a housing which both contains control mechanisms and supports supply conduits and hand pieces.

2. State of the Art:

Dental control units provide for chairside positioning of dental handpiece-supporting trays. They usually include control structure for the handpieces. The control units are supported for pivotal movement on a cantilevered swinging arm so that they may be positioned closely adjacent a dental patient's chair. They are intended to be easily accessible to a dentist or dental technician, without obstructing the view or necessary operating room of the dentist and without being obtrusive to a patient.

Dental control units in general include a base mounted to swing with and to pivot on a support arm. A housing fits over the base to provide a cover for control mechanisms carried by the base and serving as flow control means for utility supply conduits extending from the base. Typical such dental control units support a plurality of dental hand pieces, the associated utility supply conduits and structure for controlling flow through the conduits.

In "Continental" style dental control units, the supply conduits extend through semi-rigid pivoted "whip" arms. These arms are provided to maintain separation of the conduits, to prevent tangling of the conduits and other structure and to ensure proper positioning of the handpieces on the top surface of the housing when not in use. The conduits terminate in quick release ends to which dental hand pieces are attached, and provide means for supplying vacuum, water, air and various solutions to the hand pieces.

The top surfaces of the housings are made to be easily cleaned. Nevertheless, these surfaces are subject to spatter of fluids occurring during dental procedures and use of the hand pieces. They thus require frequent cleaning, and often they are not adequately cleaned.

The dental profession and the public have become increasingly aware of the need for infection control and cleanliness in dental operatories. There remains a need for improved means for providing each successive patient with a clean, spatter free operatory environment. This need is particularly apparent in connection with the surfaces of the dental control units present in typical such operatories.

SUMMARY OF THE INVENTION

The present invention provides a cleanable, interchangeable fitted cover for dental control units. It also provides an improved dental control unit with such a fitted cover over the top surface of a housing. The cover receives all spatter from above and from the front of the housing. The cover is ordinarily fashioned as a unitary piece from a rigid or semi-rigid material, such as a suitable plastic. The material selected should be easily cleaned and tolerant of sterilization and/or disinfection procedures. The cover is usually formed to fit snugly over the top surface of a dental control unit housing. Preferably, the cover should snap into locking engagement with the housing. Its exposed surface is desirably smooth to facilitate cleaning.

The cover of this invention is configured to support and retain utility delivery conduits and associated distal fixtures. For example, spaced apart cavities may be formed in the top surface of the cover. The cavities may be relatively narrow adjacent the back edge of the cover to accommodate a conduit. Each respective cavity may be configured along its length as appropriate to accommodate attachment fittings on the ends of the conduits and dental handpieces connected to the attachment fittings.

BRIEF DESCRIPTION OF THE DRAWINGS

In the drawings, which illustrate what is currently regarded as the best mode for carrying out the invention.

DETAILED DESCRIPTION OF THE ILLUSTRATED EMBODIMENT

In the illustrated preferred embodiment of the invention, the dental control unit is shown generally at 10. As shown, the control unit includes a base 11, a housing 12 and a top cover 13.

Figure 1:
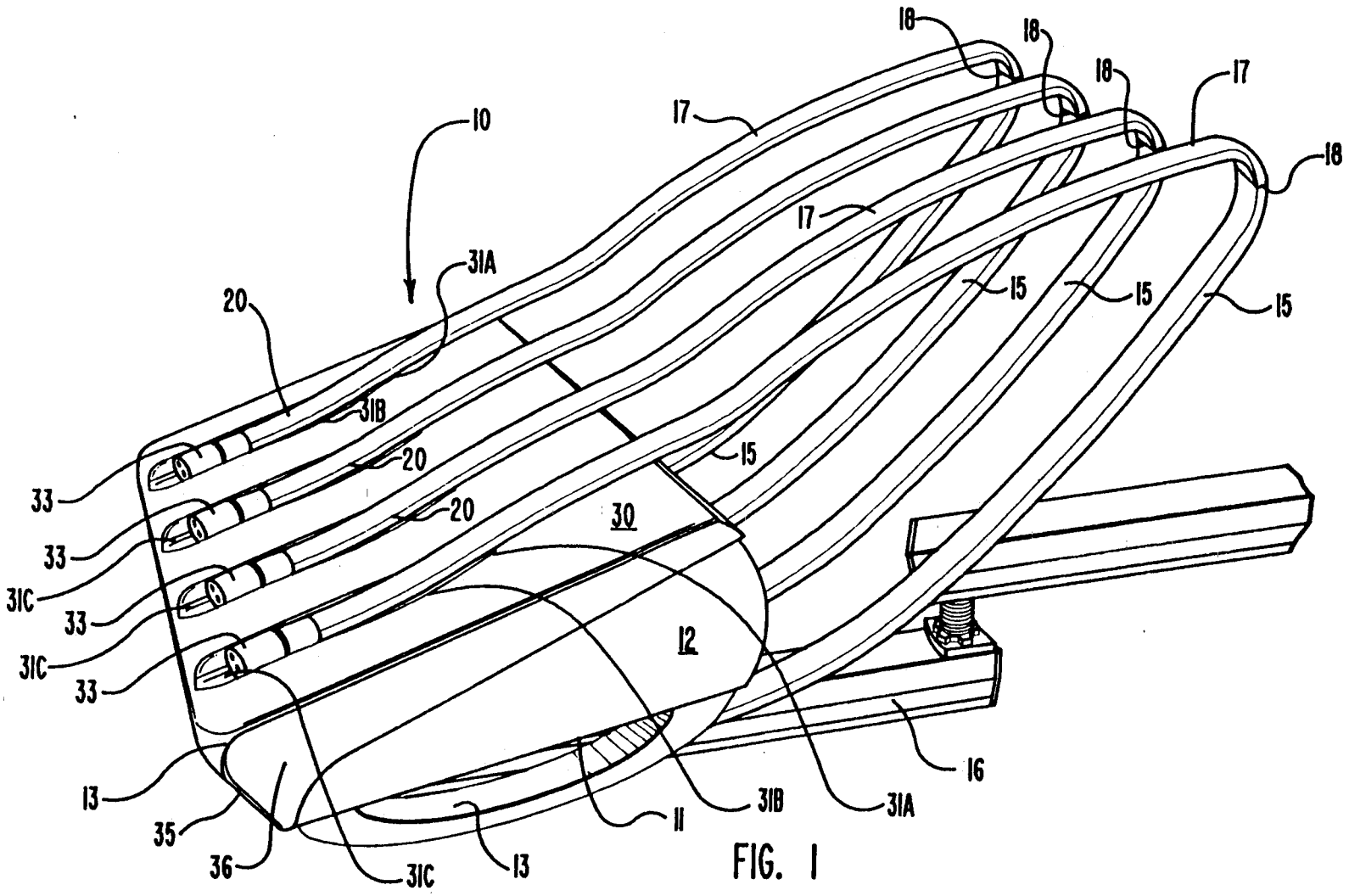
FIG. 1 is a perspective view of a control unit of the invention.
Figure 2:
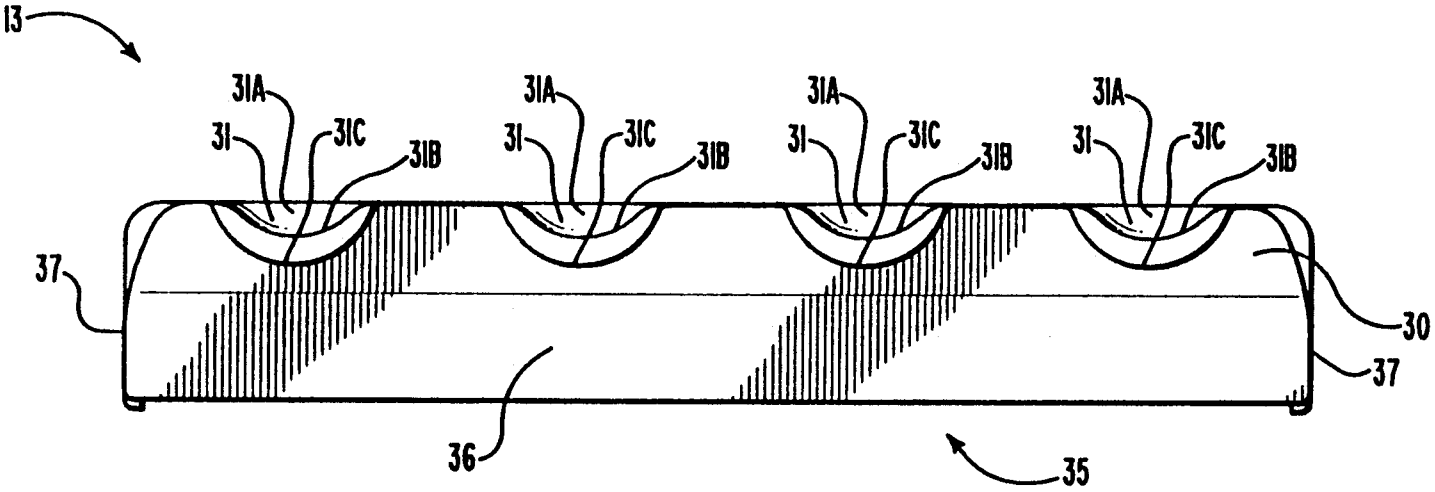
FIG. 2 is a front elevation view of the control unit of FIG. 1.
Figure 4:
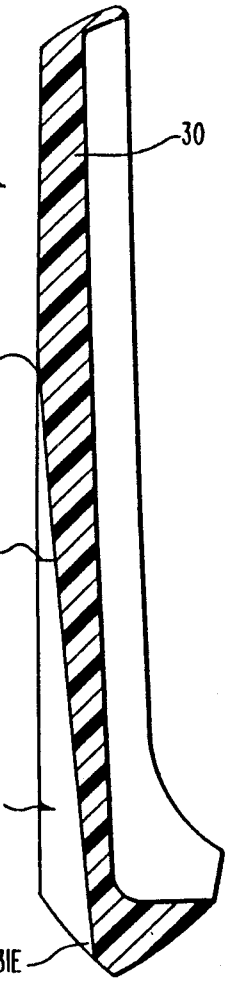
FIG. 4 is a sectional view, taken on the line 4—4 of FIG. 3.

Whip arms 15 are pivotally connected at ends 16 to the base 11. Conduits 17 pass through the arms 15 from the pivot ends 16 to exit free ends 18. The whip arms 15 pivot between a rear conduit rest position (FIG. 1) and a forward conduit use position (not shown). When in the rear conduit rest position, the free end 20 of the associated conduit 17 rests on the top cover 13.

The usual mechanisms for controlling flow through the conduit are mounted on the base 11, within housing 12, and are connected to the conduits 17. The flow controlling mechanisms are conventional and are not shown.

The housing 12 is secured to the base 11 in any suitable manner. Typically, the housing is pivotally connected to the base at either the rear or the front edge of the base so that the housing can be pivoted to provide access to conduit control mechanisms contained therein. In normal use, however, the housing 12 is secured to the base 11 as shown to enclose, cover and protect these control mechanisms.

Figure 3:
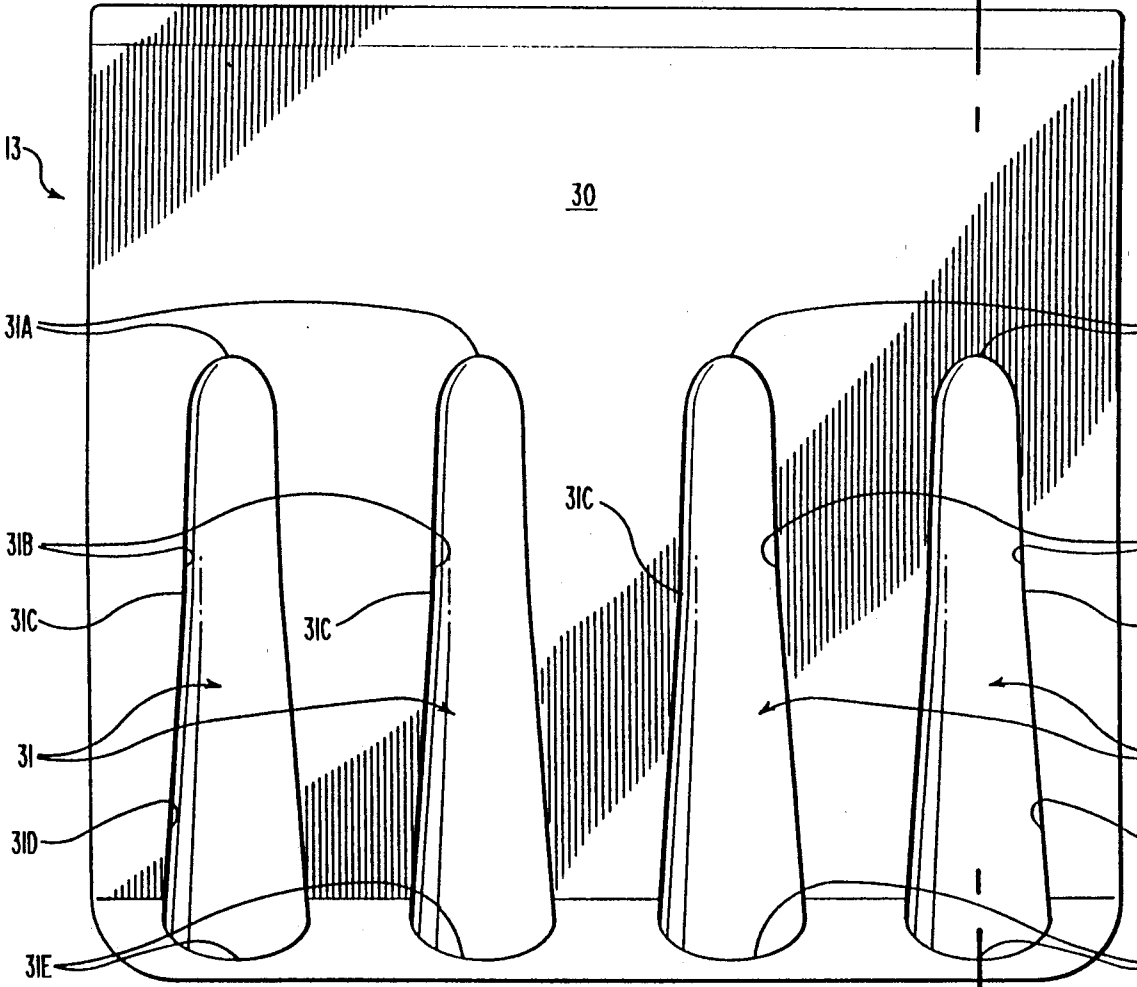
FIG. 3 is a top plan view of a top cover of the control unit of FIG. 1.

As best shown by FIG. 3, top cover 13 is formed of a unitary piece of easily cleaned, semi-rigid material, such as metal or plastic. The top cover 13 includes a top surface 30 carrying a plurality of spaced apart cavities 31. Each cavity 31 is formed as a narrow groove 31B that is gradually deepening as it extends away from an end 31A. At a location 31C, intermediate its length, each cavity is flared at 31D to terminate at an enlarged receiver end 31E.

Figure 5:
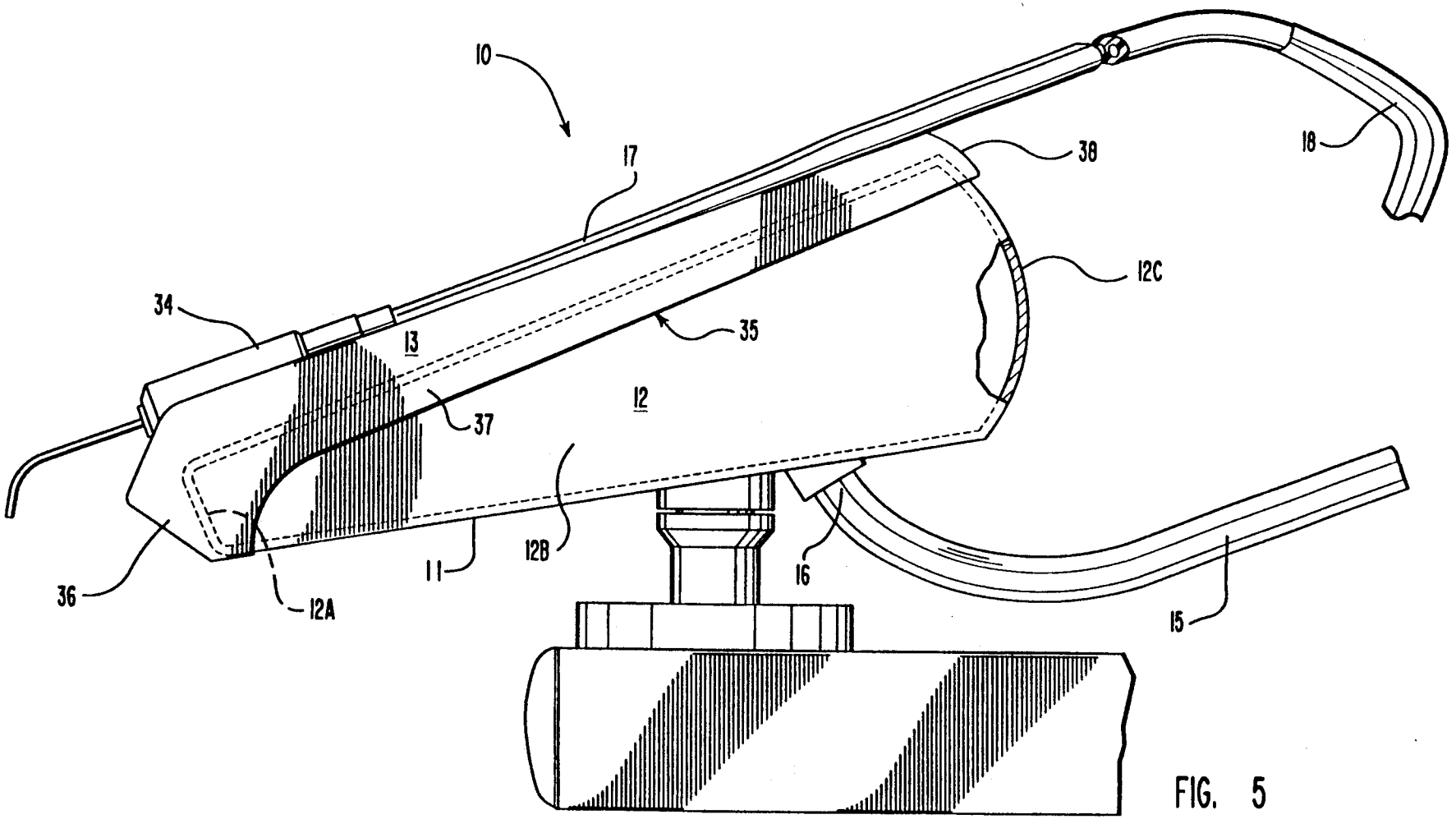
FIG. 5 is a view in side elevation, partially in section and with certain internal structures shown by phantom lines, of the control unit of FIG. 1.

When a whip arm 15 is pivoted to its rear conduit rest position, the free end 20 of its associated conduit 17 is rested in an aligned cavity 31, with the conduit itself in the narrow groove portion 31A and a connector member 33 carried at the free end 20 resting in the flared, enlarged groove portion 31E. A handpiece 34, if attached, may rest partially in the receiver end 31E, as shown in FIG. 5.

The top cover is configured at each of its front, rear and side edges to form a peripheral enclosure 35 that depends from the top surface 30 and that fits fully over at least the front surface of the housing and at least partially over the side and rear surfaces of the housing. As shown, the peripheral enclosure has a nosepiece 36 that fits over and extends slightly beneath a front wall surface 12A of housing 12; spaced apart side panels 37 that extend partially down and tightly grip spaced apart side walls 12B of the housing; and a tailpiece 38 that extends downwardly over and tightly grips a portion of a rear wall surface 12C of the housing. The side panels 37 interconnect the nosepiece 36 and tailpiece 38. Ideally, the walls of the housing are shaped to position any uncovered surfaces out of the probable path of spattered fluids.

In use, a dentist or dental technician will pick up a handpiece 34 from its rest position in a cavity 31 of the top cover 13 and move it towards a patient. The associated whip arm 15 will swing to the use position (not shown). Very little pull is required to move the handpiece and the whip arms ensure that the conduits, attachment means and handpieces do not tangle during use.

As the handpiece is placed back in its cavity 31 on the top cover 30, the whip arm 15 and conduit 17 return to the conduit rest position, ready for a subsequent use.

The top cover 13, provides a location for convenient positioning and storage of the dental handpieces and attached conduits while also serving to protect the housing from contamination from spatter, spills and other sources of contamination. The top cover 13 is easily wiped clean and is easily removed to be replaced by another such top cover and/or to be cleaned, by immersion, for example. To remove the top cover 13, it is only necessary to lift it from the housing 12. To reinstall the top cover or to replace it with a similar cover, it is only necessary to position the cover being installed over the housing and to push down. The cover 13 is thereby brought to rest on the top surface of the housing with the peripheral enclosure 35 engaging the front 12A, side 12B and rear 12C walls of the housing 12.

While a preferred embodiment of the invention has been disclosed, it is intended that the invention be limited only by the appended claims, including reasonable equivalents.

What is claimed is:

1. A dental control unit for supporting dental handpieces comprising:

a base;

a housing mounted on the base;

at least one conduit having one end secured to the base, and having attachment means on the other end;

a dental handpiece connected to the attachment means on the other end;

a top cover removably fitted over a top surface of said housing and including means on a top surface of the top cover to receive said handpiece and a portion of said conduit.

2. A dental control unit as in claim 1, wherein:

said top cover has spaced cavities formed in said top surface to secure said handpiece and a portion of said conduit.

3. A dental control unit as in claim 2, wherein:

said top cover is configured with a peripheral enclosure projecting downwardly from said top surface, thereby engaging walls of said housing.

4. A dental control unit as in claim 3, wherein:

said top cover is unitary and made of a semi-rigid, flexible material.

5. A removable top cover for use on a dental control unit housing comprising:

a unitary sheet of semi-rigid, flexible material sized to cover a top surface of a control unit housing and configured to include a peripheral enclosure constructed and arranged to engage walls of said control unit housing; said enclosure including an upper surface configured to include at least one cavity adapted to receive a dental handpiece and a portion of a conduit connected to said handpiece.

6. A removable top cover for use on a dental control unit, as in claim 5, wherein:

a plurality of said cavities are formed in said upper surface and are arranged in side by side parallel relationship.

7. A removable top cover for use on a dental control unit, as in claim 6, wherein:

said peripheral enclosure includes a nosepiece and a rear wall, said nosepiece and said rear wall being interconnected by spaced apart side walls.

8. A removable top cover for use on a dental control unit, as in claim 7, wherein:

each said cavity extends into said nosepiece and towards said rear wall.

9. A removable top cover for use on a dental control unit as in claim 8, wherein:

each said cavity deepens as it extends from the end thereof proximate said rear wall into said nosepiece.

10. A removable top cover for use on a dental control unit as in claim 9, wherein:

each said cavity is formed as a channel extending from said end proximate said rear wall and said channel has walls flared at a location intermediate the length of said channel to the end of said channel in said nosepiece.

* * * * *